US009159470B2

(12) United States Patent
Mutnury et al.

(10) Patent No.: US 9,159,470 B2
(45) Date of Patent: Oct. 13, 2015

(54) DUAL AXIAL CABLE

(71) Applicant: Dell Products L.P., Round Rock, TX (US)

(72) Inventors: Bhyrav M. Mutnury, Round Rock, TX (US); Sandor Farkas, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 141 days.

(21) Appl. No.: 14/107,407

(22) Filed: Dec. 16, 2013

(65) Prior Publication Data

US 2015/0170794 A1 Jun. 18, 2015

(51) Int. Cl.

| | |
|---|---|
| ***H01B 7/00*** | (2006.01) |
| ***H01B 7/17*** | (2006.01) |
| ***H01B 11/00*** | (2006.01) |
| ***H01B 3/00*** | (2006.01) |
| ***H01B 7/04*** | (2006.01) |
| ***H01B 13/016*** | (2006.01) |

(52) U.S. Cl.

CPC .. *H01B 7/17* (2013.01); *H01B 3/00* (2013.01); *H01B 7/04* (2013.01); *H01B 11/002* (2013.01); *H01B 13/016* (2013.01)

(58) Field of Classification Search

USPC ..... 174/36, 102 R, 108, 109, 110 R, 113 R, 174/117 R, 117 F

See application file for complete search history.

(56) References Cited

U.S. PATENT DOCUMENTS

| | | | | |
|---|---|---|---|---|
| 5,283,390 | A * | 2/1994 | Hubis et al. | 174/36 |
| 5,483,020 | A * | 1/1996 | Hardie et al. | 174/36 |
| 6,076,235 | A * | 6/2000 | Khokhar | 24/25 |
| 6,677,534 | B2 * | 1/2004 | Yamamoto et al. | 174/113 R |
| 7,323,640 | B2 * | 1/2008 | Takahashi et al. | 174/106 R |
| 7,790,981 | B2 * | 9/2010 | Vaupotic et al. | 174/36 |

* cited by examiner

*Primary Examiner* — William H Mayo, III

(74) *Attorney, Agent, or Firm* — Jackson Walker L.L.P.

(57) ABSTRACT

A dual axial cable that may include two substantially parallel and substantially adjacent wires, wherein each wire is formed from an electrical conductor surrounded throughout its length by a bifurcated electrical insulator. Each bifurcated electrical insulator may include a first portion of electrically insulative material and a second portion of electrically insulative material having a dielectric constant substantially higher than a dielectric constant of the first portion, such that a cross-section of each wire includes its respective first portion and respective second portion. The cable may be configured such that throughout the length of the cable, the second portions of each of the two wires are substantially adjacent to each other.

20 Claims, 4 Drawing Sheets

DUAL AXIAL CABLE

TECHNICAL FIELD

The present disclosure relates in general to information handling systems, and more particularly to systems and methods for constructing a dual axial cable.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

In many applications, one or multiple information handling servers may be installed within a single chassis, housing, enclosure, or rack. Communication between servers and/or between enclosures may often be accomplished via cables, and many communications standards and protocols employ a copper cable implementation for differential signaling. For example, a shielded dual axial differential pair cable 10, a cross section of which is shown in FIG. 1, is traditionally used for short to medium reach (e.g., less than 10-20 meters) in standards including, but not limited to, Serial Attached Small Computer System Interface (SAS), InfiniBand, Serial Advanced Technology Attachment (SATA), Peripheral Component Interconnect Express (PCIe), Double Speed Fibre Channel, Synchronous Optical Networking (SONET), Synchronous Digital Hierarchy (SDH), and 10 Gigabit Ethernet (10 GbE). As shown in FIG. 1, cable 10 may include two substantially parallel and substantially adjacent wires 12 each formed from an electrical conductor 14 (e.g., copper), surrounded throughout the length of conductor 14 by an electrical insulator 16 (e.g., plastic), an electrically grounded drain 18 comprising an electrical conductor (e.g., copper) running substantially parallel to and substantially adjacent to each of the wires, and an electrically grounded shield 20. Shield 20 may comprise foil of an electrical conductor (e.g., aluminum) wrapped around wires 12 and drain 18 in a helical fashion.

However, to ensure complete shielding by shield 20 in the presence of cable bending, shield 20 is typically wrapped with a significant amount of overlap. As a result of such overlap, the axial direction of shield 20 (e.g., parallel with the length of wires 12) will include a periodic impedance discontinuity. In such a cable 10, return current may be strongest at the lateral portions of cable 10 (e.g., on the left and right of cable 10 in the orientation shown in FIG. 1), while being weaker in other areas (e.g., on the left and right of cable 10 in the orientation shown in FIG. 1). Thus, a significant portion of the return current may flow through the periodic discontinuity of shield 20, potentially leading to resonance at an undesired frequency, thus likewise potentially leading to lower available signal bandwidth on the cable than would otherwise be available in absence of the resonance.

One solution to this problem has been to construct a cable 30 with a dual drain construction, a cross section of which is shown in FIG. 2. As shown in FIG. 2, each of two electrically-grounded drains 18 may be formed laterally to, substantially in parallel with, and substantially adjacent to, a respective wire 12. In such a construction, while some return current may flow on shield 20, the largest portion of such return current may flow through drains 18, thus avoiding the periodic impedance discontinuity of shield 20, and reducing the occurrence of undesired resonance. However, such a dual-drain cable 30 increases cable size (e.g., width) over a similar single-drain cable 10, which may not be suitable for applications in which a high volume of cables is required.

Another solution to the shield-induced resonance problem has been to construct a cable with a uniform shield. However, such solutions are often cost-prohibitive, as cost may exponentially increase as cable length increases.

SUMMARY

In accordance with the teachings of the present disclosure, the disadvantages and problems associated with resonance in dual axial cables may be reduced or eliminated.

In accordance with embodiments of the present disclosure, a dual axial cable may include two substantially parallel and substantially adjacent wires, each wire formed from an electrical conductor surrounded throughout its length by a bifurcated electrical insulator. Each bifurcated electrical insulator may include a first portion of electrically insulative material and a second portion of electrically insulative material having a dielectric constant substantially higher than a dielectric constant of the first portion, such that a cross-section of each wire includes its respective first portion and respective second portion. The cable may be configured such that throughout the length of the cable, the second portions of each of the two wires are substantially adjacent to each other.

In accordance with these and other embodiments of the present disclosure, a method for forming a dual axial cable may include forming each of two wires by surrounding an electrical conductor through its length by a bifurcated electrical insulator. Each bifurcated electrical insulator may include a first portion of electrically insulative material and a second portion of electrically insulative material having a dielectric constant substantially higher than a dielectric constant of the first portion, such that a cross-section of each wire includes its respective first portion and respective second portion. The method may also comprise arranging the two wires in a substantially parallel and substantially adjacent manner with the cable such that throughout the length of the cable, the second portions of each of the two wires are substantially adjacent to each other.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Preferred embodiments and their advantages are best understood by reference to FIGS. 3 through 6B, wherein like numbers are used to indicate like and corresponding parts.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

For the purposes of this disclosure, information handling resources may broadly refer to any component system, device or apparatus of an information handling system, including without limitation processors, service processors, basic input/output systems, buses, memories, I/O devices and/or interfaces, storage resources, network interfaces, motherboards, air movers, sensors, power supplies, and/or any other components and/or elements of an information handling system.

Figure 3:
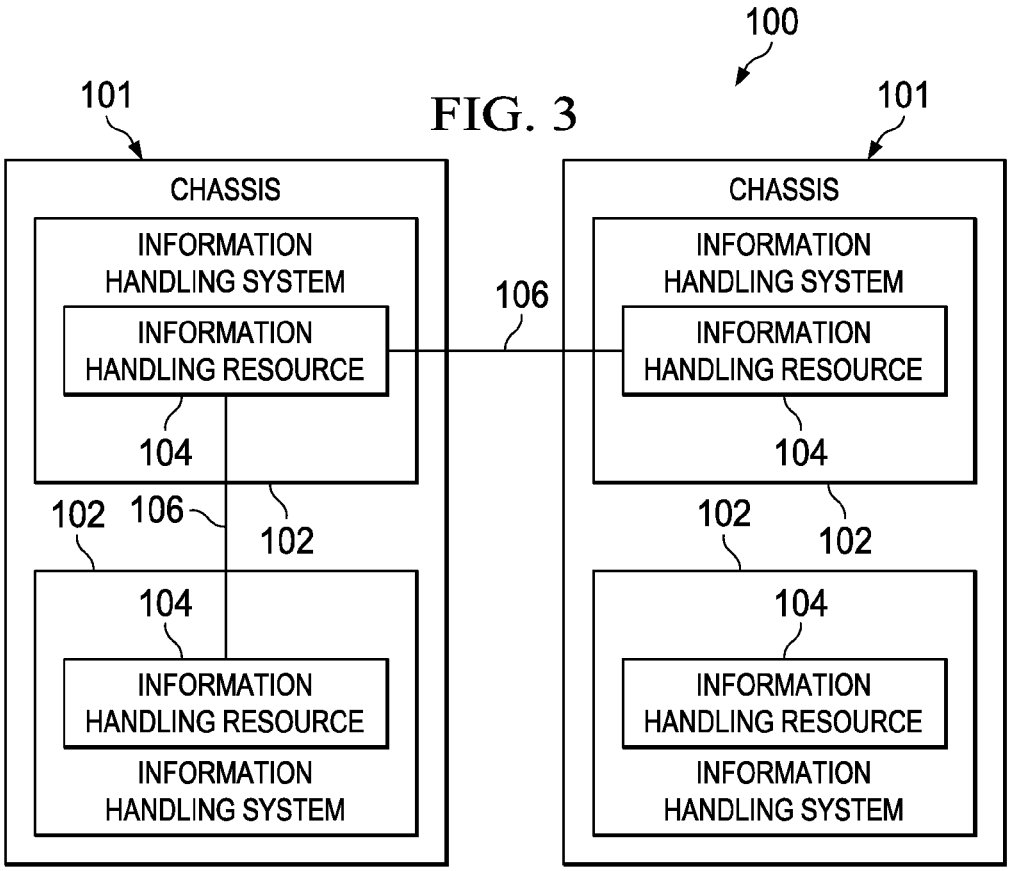
FIG. 3 illustrates a system comprising a plurality of chassis, each chassis comprising at least one information handling system, in accordance with embodiments of the present disclosure.

FIG. 3 illustrates a system 100 comprising a plurality of chassis 101, each chassis 101 comprising at least one information handling system 102, in accordance with embodiments of the present disclosure. Each chassis 101 may be an enclosure that serves as a container for various information handling systems 102 and information handling resources 104, and may be constructed from steel, aluminum, plastic, and/or any other suitable material. Although the term "chassis" is used, a chassis 101 may also be referred to as a case, cabinet, tower, box, enclosure, and/or housing. In certain embodiments, a chassis 101 may be configured to hold and/or provide power to one or more information handling systems 102 and/or information handling resources 104.

In some embodiments, one or more of information handling systems 102 may comprise servers. For example, in some embodiments, information handling systems 102 may comprise rack servers and each chassis 101 may comprise a rack configured to house such rack servers. As shown in FIG. 3, each information handling system 102 may include one or more information handling resources 104. An information handling resource 104 may include any component system, device or apparatus of an information handling system 102, including without limitation processors, service processors, basic input/output systems, buses, memories, I/O devices and/or interfaces, storage resources, network interfaces, motherboards, air movers, sensors, power supplies, and/or any other components and/or elements of an information handling system. For example, in some embodiments, an information handling resource 104 of an information handling system 102 may comprise a processor. Such processor may include any system, device, or apparatus configured to interpret and/or execute program instructions and/or process data, and may include, without limitation, a microprocessor, microcontroller, digital signal processor (DSP), application specific integrated circuit (ASIC), or any other digital or analog circuitry configured to interpret and/or execute program instructions and/or process data. In some embodiments, a processor may interpret and/or execute program instructions and/or process data stored in a memory and/or another information handling resource of an information handling system 102.

In these and other embodiments, an information handling resource 104 of an information handling system 102 may comprise a memory. Such a memory may be communicatively coupled to an associated processor and may include any system, device, or apparatus configured to retain program instructions and/or data for a period of time (e.g., computer-readable media). A memory may include RAM, EEPROM, a PCMCIA card, flash memory, magnetic storage, opto-magnetic storage, or any suitable selection and/or array of volatile or non-volatile memory that retains data after power to an associated information handling system 102 is turned off.

In addition to a processor and/or a memory, an information handling system 102 may include one or more other information handling resources.

As shown in FIG. 3, information handling resources 104 may be communicatively coupled to each other via a cable 106, whether such information handling resources 104 are within different information handling systems 102 in the same chassis 101, or are in different chassis 101. A cable 106 may include any suitable assembly of two or more electrically-conductive wires running side by side to carry one or more signals between information handling resources. In some embodiments, such a cable 106 may include a shielded dual axial cable for communicating differential signals such as that shown in FIGS. 4 through 6B and described in greater detail below.

Figure 4:
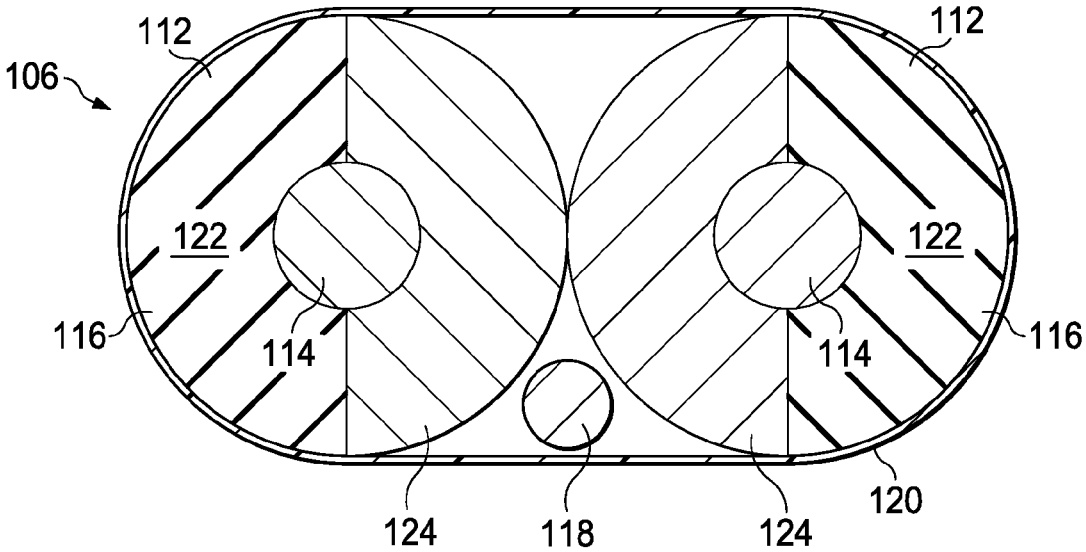
FIG. 4 illustrates a cross-sectional view of a shielded single-drain dual axial cable comprising wires each having a bifurcated insulator, in accordance with embodiments of the present disclosure.

FIG. 4 illustrates a cross-sectional view of a shielded single-drain dual axial cable 106 comprising a pair of wires 112 each having a bifurcated insulator 116 surrounding an electrical conductor 114, in accordance with embodiments of the present disclosure. As shown in FIG. 4, cable 106 may include substantially parallel and substantially adjacent wires 112 each formed from an electrical conductor 114 (e.g., copper), surrounded throughout the length of electrical conductor 114 by a bifurcated electrical insulator 116, a drain 118 comprising an electrical conductor (e.g., copper) running substantially parallel to and substantially adjacent to each of wires 112, and an electrically-grounded shield 120. In operation (e.g., when coupled to an information handling resource), each of drain 118 and shield 120 may be electrically grounded. Shield 120 may comprise foil of an electrical conductor (e.g., aluminum) wrapped around wires 112 and drain 118 in a helical fashion.

Each bifurcated electrical insulator 116 may surround the cylindrical circumference of its associated electrical conductor 114 (or, if the cross section of electrical conductor 114 is not circular in shape, the perimeter of electrical conductor 114). Each bifurcated electrical insulator 116 may comprise a first portion 122 and a second portion 124, wherein each of first portion 122 and second portion 124 are electrically insulative, with second portion 124 having a dielectric constant substantially higher than that of first portion 122. In preferred embodiments, bifurcated electrical insulator 116 may be constructed such that for a given cross-section, first portion 122 is approximately equal in size to second portion 124 (e.g., within manufacturing tolerances), as depicted in FIG. 4. In these and other embodiments, cable 106 may be constructed such that the second portions 124 of each wire 112 are, throughout the length of cable 106, oriented such that second portions 124 of each wire 112 are substantially adjacent to each other (e.g., second portions 124 are oriented within manufacturing tolerances such that a point of the outer perimeter of one second portion 124 is in contact with or in substantial proximity with a point of the outer perimeter of the other second portion 124) near the center of cable 106, while first portions 122 are opposite of each other at the lateral sides of cable 112. As used herein, the term "perimeter" is intended to broadly include a circumference of a circle or circular section. In addition or alternatively, cable 106 may be constructed such that the second portions 124 of each wire 112 are, throughout the length of cable 106, oriented such that second portions 124 of each wire 112 are substantially adjacent to drain 118 (e.g., second portions 124 are oriented within manufacturing tolerances such that a point of the outer perimeter of each second portion 124 is in contact with or in substantial proximity with a respective point of the outer perimeter of drain 118).

In preferred embodiments, a cross-section of second portions 124 may be substantially symmetrical (e.g., symmetrical within manufacturing tolerances) to each other about a line in the plane of the cross-section that bisects the cross-section (e.g., which is perpendicular to a second line in the plane defined by the centers of electrical conductors 114), as shown in FIG. 4.

In addition, in preferred embodiments, cable 106 may be constructed such that in a cross-section of cable 106, a center of the outer perimeter of one second portion 124 is substantially adjacent to a center of the outer perimeter of the other second portion 124 (e.g., second portions 124 are oriented within manufacturing tolerances such that the center points of the outer perimeter of each second portion 124 are in contact with or in substantial proximity to each other).

Figure 5A:
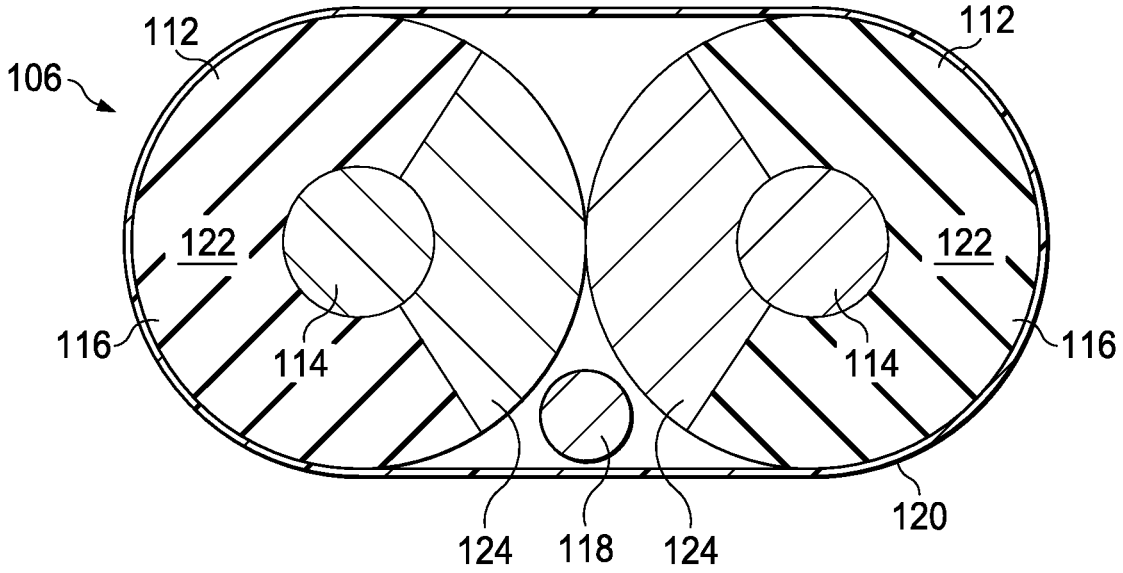
FIGS. 5A and 5B each illustrate a cross-sectional view of alternative embodiments of a shielded single-drain dual axial cable comprising wires each having a bifurcated insulator, in accordance with embodiments of the present disclosure.
Figure 5B:
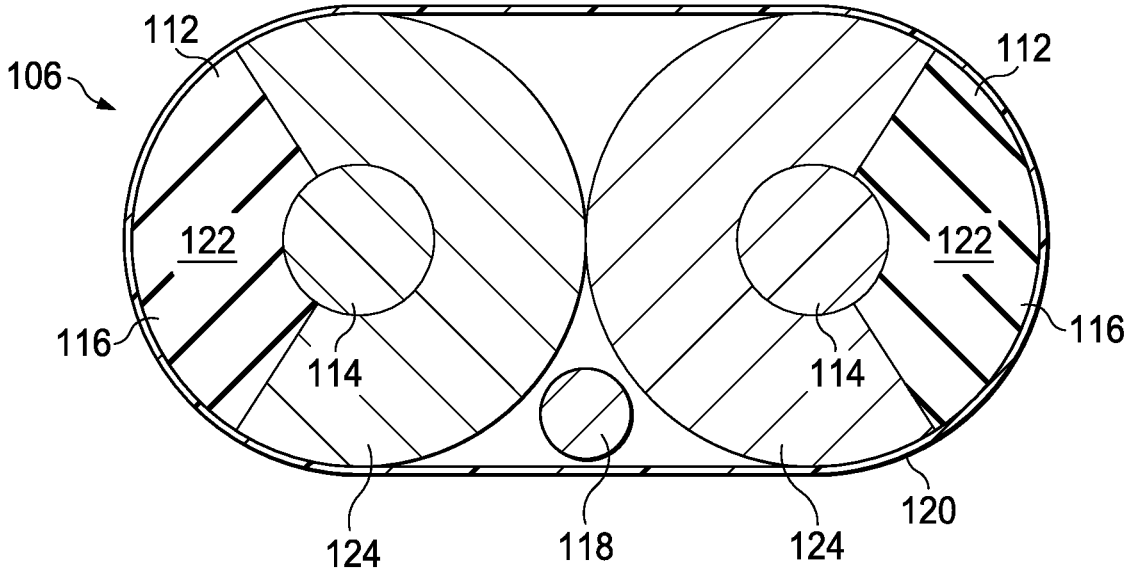

Although FIG. 4 depicts a preferred embodiment in which first portion 122 and second portion 124 of each electrical insulator 116 are substantially equal in size, other embodiments of cable 106 may include wires 112 in which first portions 122 are larger in size than second portions 124 (as in FIG. 5A) or vice versa (as in FIG. 5B). In such embodiments, cable 106 may be constructed such that second portions 124 are substantially adjacent to each other (e.g., including embodiments in which the centers of their respective outer perimeters are substantially adjacent to each other) and/or substantially adjacent to drain 118. In these and other embodiments, cable 106 may be constructed such that a cross-section of second portions 124 may be substantially symmetrical (e.g., symmetrical within manufacturing tolerances) to each other about a line in the plane of the cross-section that bisects the cross-section.

Figure 6A:
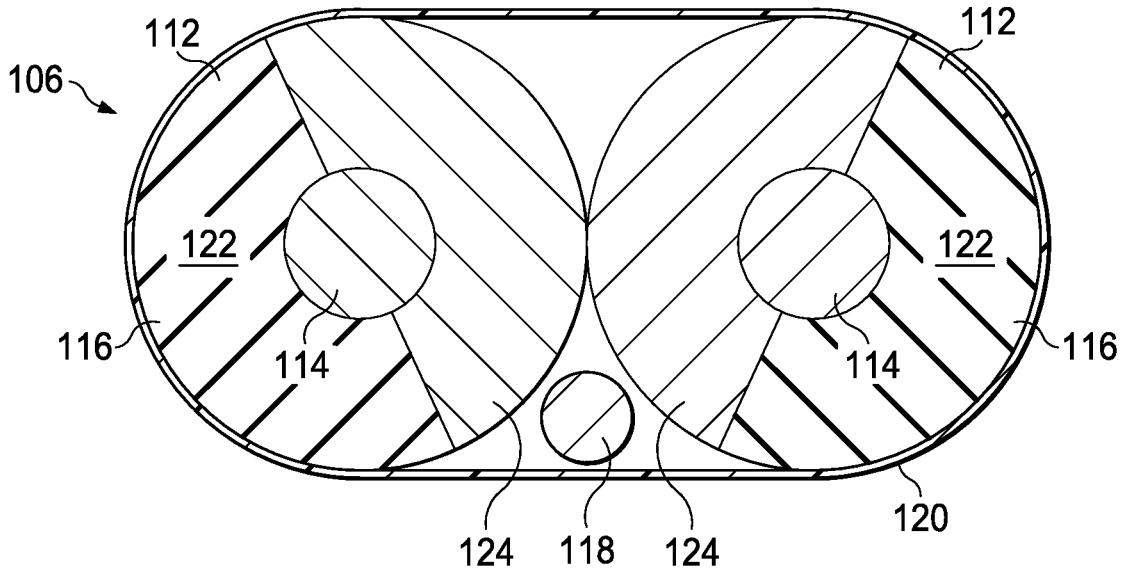
FIGS. 6A and 6B each also illustrate a cross-sectional view of alternative embodiments of a shielded single-drain dual axial cable comprising wires each having a bifurcated insulator, in accordance with embodiments of the present disclosure.
Figure 6B:
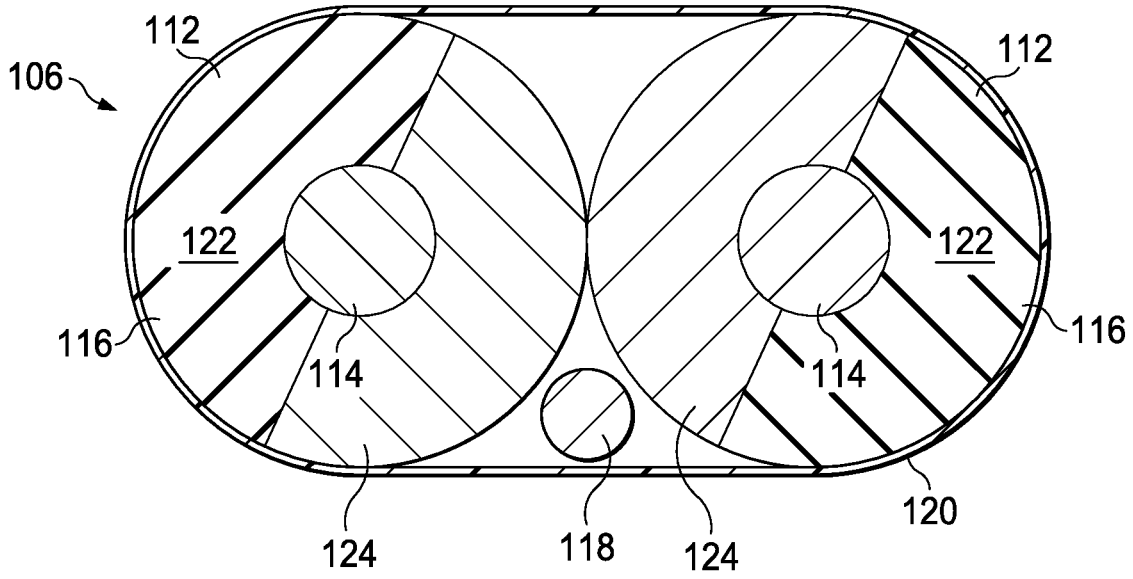

As mentioned above, due to manufacturing tolerances or defects present in bulk manufacturing, the construction of a cable 106 may deviate from an "ideal" or preferred construction, as shown in FIGS. 6A and 6B. For example, in each of FIGS. 6A and 6B, wires 112 are rotated from the preferred orientations shown in FIG. 4 due to manufacturing tolerances or other defects. Nonetheless, in spite of such deviations, second portions 124 may remain substantially adjacent to each other (e.g., including embodiments in which the centers of their respective outer perimeters are substantially adjacent to each other) and/or substantially adjacent to drain 118, such that the manufacturing tolerances resulting in deviations from the ideal cross-section have no significant impact on cable performance.

A wire 112 may be constructed or manufactured in any suitable manner. For example, a length of electrical conductor 114 may be extruded through two types of molten plastic or other material making up each of first portion 122 and second portion 124 in a manner similar to that typically employed when insulator 116 is made of a single material, with modifications to known processes being made to give first portion 122 and second portion 124 their desired orientations and sizes.

Figure 1:
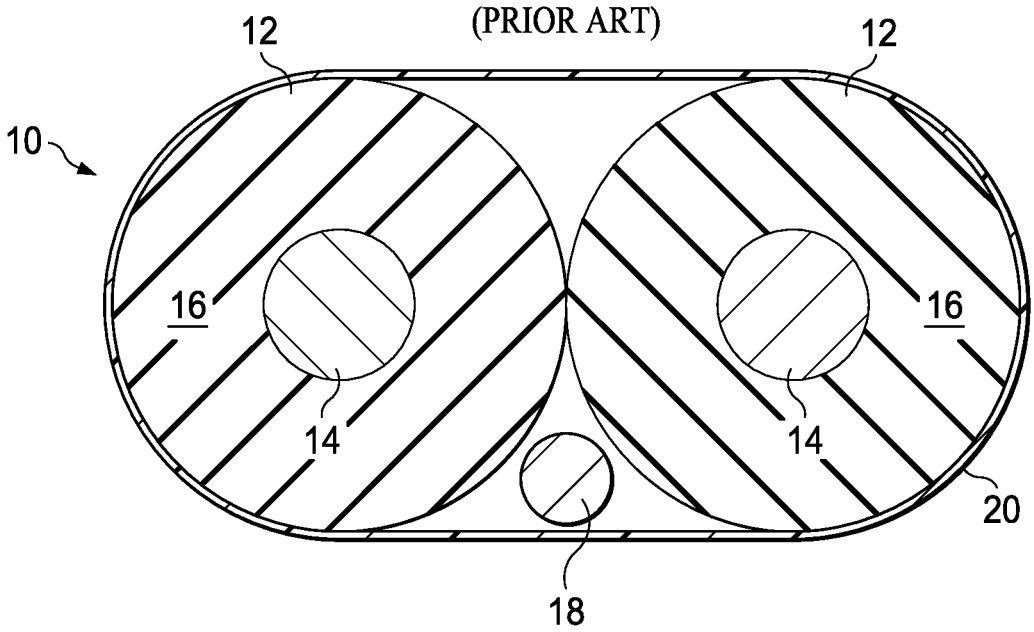
FIG. 1 (PRIOR ART)
FIG. 1 illustrates a cross-sectional view of a single-drain dual axial cable, as is known in the art.
Figure 2:
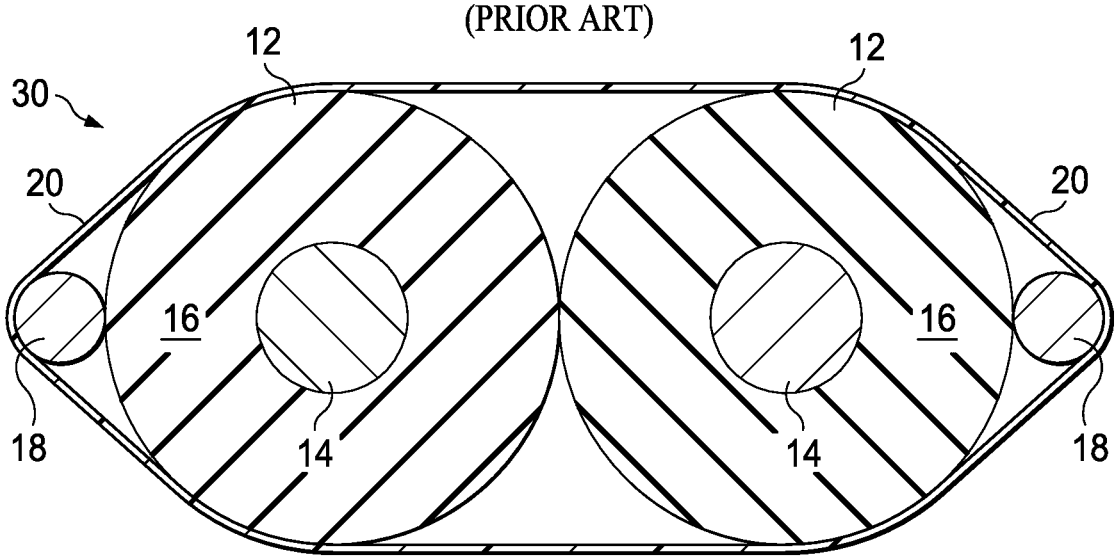
FIG. 2 (PRIOR ART)
FIG. 2 illustrates a cross-sectional view of a double-drain dual axial cable, as is known in the art.

As constructed in accordance with the manner described above, electrical fields associated with return current may be concentrated near the center of cable 106 (e.g., between electrical conductors 114 and between each electrical conductor 114 and drain 118) such that drain 118 carries a bulk of the return current, allowing the bulk of return current to avoid the impedance discontinuity of shield 120, while avoiding the need to construct a larger cable with two outer drains 18 as shown in FIG. 2.

Although the present disclosure has been described in detail, it should be understood that various changes, substitutions, and alterations can be made hereto without departing from the spirit and the scope of the disclosure as defined by the appended claims.

What is claimed is:

1. A dual axial cable, comprising:

two substantially parallel and substantially adjacent wires, each wire formed from an electrical conductor surrounded throughout its length by a bifurcated electrical insulator;

wherein each bifurcated electrical insulator comprises:

a first portion of electrically insulative material; and a second portion of electrically insulative material having a dielectric constant substantially higher than a dielectric constant of the first portion;

such that a cross-section of each wire includes its respective first portion and respective second portion; and wherein the cable is configured such that throughout the length of the cable, the second portions of each of the two wires are substantially adjacent to each other.

2. The dual axial cable of claim 1, wherein the cable is configured such that in a cross-section of the cable, a center of an outer perimeter of one second portion is substantially adjacent to a center of an outer perimeter of the other second portion.

3. The dual axial cable of claim 1, wherein the cable is configured such that in a cross-section of the cable, the second portions of the two wires are substantially symmetrical to each other about a line in the plane of the cross-section that bisects the cross-section.

4. The dual axial cable of claim 1, wherein the cable is configured such that in a cross-section of at least one of the two wires, the first portion of such wire is approximately equal in area to the second portion of such wire.

5. The dual axial cable of claim 1, further comprising a drain comprising an electrical conductor running substantially parallel to and substantially adjacent to each of the two wires.

6. The dual axial cable of claim 5, wherein the cable is configured such that the second portions of each of the two wires are substantially adjacent to the drain.

7. The dual axial cable of claim 5, further comprising a shield of electrically conductive material surrounding the two wires and the drain.

8. The dual axial cable of claim 7, wherein the shield comprises foil of electrically conductive material wrapped around the two wires and the drain in a helical fashion.

9. The dual axial cable of claim 1, further comprising a shield of electrically conductive material surrounding the two wires.

10. The dual axial cable of claim 9, wherein the shield comprises foil of electrically conductive material wrapped around the two wires in a helical fashion.

11. A method for forming a dual axial cable, comprising:

forming each of two wires by surrounding an electrical conductor through its length by a bifurcated electrical insulator, wherein each bifurcated electrical insulator comprises:

a first portion of electrically insulative material; and a second portion of electrically insulative material having a dielectric constant substantially higher than a dielectric constant of the first portion;

such that a cross-section of each wire includes its respective first portion and respective second portion; and arranging the two wires in a substantially parallel and substantially adjacent manner with the cable such that throughout the length of the cable, the second portions of each of the two wires are substantially adjacent to each other.

12. The method of claim 11, further comprising arranging the two wires such that in a cross-section of the cable, a center of an outer perimeter of one second portion is substantially adjacent to a center of an outer perimeter of the other second portion.

13. The method of claim 11, further comprising arranging the two wires such that in a cross-section of the cable, the second portions of the two wires are substantially symmetrical to each other about a line in the plane of the cross-section that bisects the cross-section.

14. The method of claim 11, wherein the cable is configured such that in a cross-section of at least one of the two wires, the first portion of such wire is approximately equal in area to the second portion of such wire.

15. The method of claim 11, further arranging a drain comprising an electrical conductor substantially parallel to and substantially adjacent to each of the two wires.

16. The method of claim 15, further comprising arranging the two wires and the drain such that the second portions of each of the two wires are substantially adjacent to the drain.

17. The method of claim 15, further comprising forming a shield of electrically conductive material surrounding the two wires and the drain.

18. The method of claim 17, wherein forming the shield comprises wrapping foil of electrically conductive material around the two wires and the drain in a helical fashion.

19. The method of claim 11, further comprising forming a shield of electrically conductive material surrounding the two wires.

20. The method of claim 19, wherein forming the shield comprises wrapping foil of electrically conductive material around the two wires in a helical fashion.

* * * * *